US005943968A

United States Patent [19]

Dobson et al.

[11] Patent Number: 5,943,968

[45] Date of Patent: Aug. 31, 1999

[54] COLLAPSIBLE SUPPORT STRUCTURE

[75] Inventors: Raymond Dobson, Lancashire; Robert Dennis Taylor, Harrogate, both of United Kingdom

[73] Assignee: Senator International Limited, Lancashire, United Kingdom

[21] Appl. No.: 08/836,288

[22] PCT Filed: Nov. 13, 1995

[86] PCT No.: PCT/GB95/02653

§ 371 Date: Jul. 22, 1997

§ 102(e) Date: Jul. 22, 1997

[87] PCT Pub. No.: WO96/14777

PCT Pub. Date: May 23, 1996

[30] Foreign Application Priority Data

Nov. 12, 1994 [GB] United Kingdom ..... 9422853

[51] Int. Cl.[6] ..... A47B 3/00

[52] U.S. Cl. ..... 108/124; 108/157.1; 248/167

[58] Field of Search ..... 108/157.12, 157.1, 108/115, 124; 248/167

[56] References Cited

U.S. PATENT DOCUMENTS

| | | | |
|---|---|---|---|
| 1,649,388 | 11/1927 | Cacha . | |
| 4,341,164 | 7/1982 | Johnson | 108/157.1 |
| 4,974,526 | 12/1990 | Wiygul, Jr. | 108/157.1 |

FOREIGN PATENT DOCUMENTS

| | | |
|---|---|---|
| 0016932 | 10/1980 | European Pat. Off. . |
| 0046273 | 2/1982 | European Pat. Off. . |
| 1578716 | 11/1980 | United Kingdom . |
| 2293625 | 4/1996 | United Kingdom . |

*Primary Examiner*—Peter M. Cuomo
*Assistant Examiner*—Gerald A. Anderson
*Attorney, Agent, or Firm*—Salter & Michaelson

[57] ABSTRACT

A collapsible support structure for a removable table is disclosed. The collapsible structure comprises four legs and connecting members extending between the legs. Hinged connections between the legs and some of the connecting members provided by a pin extending from the connecting members and a hole in the top of the legs extending parallel to the legs.

15 Claims, 5 Drawing Sheets

COLLAPSIBLE SUPPORT STRUCTURE

BACKGROUND OF THE INVENTION

1. Field of the Invention

The present invention relates to a collapsible support structure and in particular to a folding or collapsible structure for supporting a removable table top or the like.

2. Discussion of the Related Art

One known folding table is described in U.S. Pat. No. 4,974,526 and comprises a folding frame assembly having two side frames and a pair of end frames on each end of the assembly. Each frame comprises top, bottom and two side rail to farm a generally rectangular structure. The end frames of each pair are hinged together and to respective side rails of the side frames so that the end frames can fold inwardly as the side frames move towards each other. The stability of the unfolded table is achieved by means of the rigid rectangular structure of each frame.

However, such a folding table has a number of disadvantages. The folding structure design requires the use of much material, typically rectangular sectioned metal, in order to provide the required stability and this gives rise to an increased cost of production and detracts from the aesthetic appearance of the structure. Furthermore, numerous hinges are used to connect the frames and these are exposed either on the legs or at the joints between the end frames. When the table is erected. Such exposed hinges are generally unattractive and can be a source of accumulation of dirt or the like.

A somewhat simpler arrangement employing fewer hinges is described in EP-A-048273. However, this arrangement still suffers from the unattractve hinge and potential accumulation of dirt mentioned earler. GB-A-2 293 625 and EP-A-O 016 932 describe alternative forms of hinges although not in the context of the colapsible structure of the present invention. These hinges are more attractive than those already mentioned but would not be suitable in the collapsible structure of the present Invention.

SUMMARY OF THE INVENTION

The present invention has been made from a consideration of these problem and in order to provide an improved collapsible support structure of the type described which is easily assembled and disassembled, which is compact when disassembled which is stable yet aesthetically pleasing when assembled but which is relatively inexpensive to manufacture.

According to the present invention there is provided a collapsible structure comprising a plurality of legs and connecting members extending between the legs a plurality of hinges associated with respective legs each hinge means comprising first and second members each adapted to engage or be connected to said connecting members, the first and second members being pivotally engaged to permit relative pivotal movement therebetween about a pivot axis characterised in that the first member comprise an aperture and the second member comprises a pin adapted to be releasably received in said aperture, the relative pivotal movement being achieved by the rotation of the pin within said aperture and pivot axis being defined by the central axis of the pin or aperture the top of each leg being formed to received the first and second members and to permit said relative pivotal movement.

Preferably one of the first or second members includes at least two means for engaging or connecting said member to at least two connecting members respectively. Such engaging means may comprise outwardly extending projections or lugs and may be adapted to be a close fit or a press fit within part, such as a hollow end, of the connecting members. Preferably the projections are releasably engaged with the connecting members. Preferably the outwardly extending projections or lugs extend orthogonally outward from a body of the first or second member.

Preferably the second member includes means for engaging or connecting the member to a connecting member. Such means may comprise an outwardly extending projection or lug and may be adapted to be a close fit or a press fit within part, such as a hollow end, of the connecting member.

The first member may comprise a body having a recess formed therein. One wall of the recess may have a curved surface. The second member may have a body with a curved side wall. In use, the second member can then be located within the recess of the first member so that the curved aide wall lies adjacent the curved surface.

Preferably the first and second members are each made as an integral unit, preferably from plastics, resin or the like, for example by suitable moulding techniques.

Preferably the first member comprises an elongate member which may have a generally circular, rectangular or square cross-section. Preferably outwardly extending projections or lugs, typically of rectangular cross-section, extend from said first and second members for releasable engagement within a correspondingly shaped hollow end of a connecting member. The elongate member may have a recess therein to receive part of the second member. The recess may be open at two sides thereof, the other two sides being formed by a substantially straight side wall section and a curved end wall section. The aperture may extend from the base of the recess through or partly through the lower portion of the elongate member and preferably in the direction of the longitudinal axis of the elongate member. The second member preferably has a base portion from which the pin extends, the base portion having a curved end surface corresponding to the curved end wall section of the first member to permit said relative movement when the base portion is located within the recess of the first member. The pin may extend through the whole or part only of the aperture.

Preferably, some of the connecting members are folding members for allowing the structure to be transformed between erected and collapsed configurations such that the largest external horizontal dimension of the structure in th collapsed configuration does not exceed the largest external horizontal dimension of the structure in the erected configuration, each folding member being pivoted adjacent central region thereof and each end of each folding member being pivotably mounted adjacent a corresponding log of the structure one or both of said folding members and one or more of said connecting members being pivotally connected together by means of a hinge.

Preferably one or both folding members is provided with a cover member adapted to cover the central pivot region when the structure is in the erected position.

Preferably the cover member is a sliding cover adapted to slide over at least part of the folding member as or when the structure is erected. Part of the cover member may be secured, for example by bonding or welding, to the folding member at one side of the central pivot region. Another part of the cover member may be adapted to side over a section of the folding member on the other side of the central pivot region.

Preferably the structure comprises two or more support frames each having legs connected by a connecting member. Each support frame may be pivotally connected adjacent respective ends thereof to respective folding members. Preferably each folding member comprises at least two members pivotally connected together.

Preferably the cover member comprises an elongate channel-section member and may have a cross-sectional shape and dimension corresponding at least in part to that of the folding member.

Preferably the various pivotal connections comprise hinges or hinge means. Preferably the support frames comprise two support legs connected together adjacent respective ends thereof by a connecting member.

Preferably the folding member comprise two members connected together adjacent respective one ends thereof by a hinge located on one side of or within the ends of the members and the other ends of the two members are connected to respective support frames by respective hinges located on the opposite side of said members.

Preferably the collapsible structure has four legs, with two connecting members and two folding members arranged therebetween so that when erected the structure is rectangular.

Preferably the pivot points at the centre and ends of each folding member are implemented by hinges or hinge means. With this arrangement the folding members collapse inwardly when the structure is collapsed from the erected configuration. The cover member provides the structure with added strength when erected by reinforcing the central hinge.

The erected structure can accept a suitable surface to rest thereon. The said surface and the erected structure can be engaged to prevent relative movement by any suitable means such as blocks on the underside of the surface engaging the structure. The said surface may be a table top or a work surface, for example.

The collapsible structure may include means for allowing connecting units to be attached. Such connecting units may be similar collapsible structures, conventional tables or other furniture. This allows for the possibility of constructing any configuration of tables and furniture from modular units.

Means may also be provided for securing the structure in the folded position, for example, suitably arranged magnets, catches or the like.

The invention further provides a table comprising a table top and a collapsible structure of the invention. Preferably the table comprises a folding metal frame and a separate table top. The table top may comprise any suitable material to suit the intended use. The table legs may be square or round son and may comprise meal or wood or any other suitable cross-sectional shape or material. The tables may be inked by any suitable means and connecting units may be used to link tables.

BRIEF DESCRIPTION OF THE DRAWINGS

The invention will now be described by way of example only and with reference to the accompanying drawings in which.

DETAILED DESCRIPTION

Figure 1:
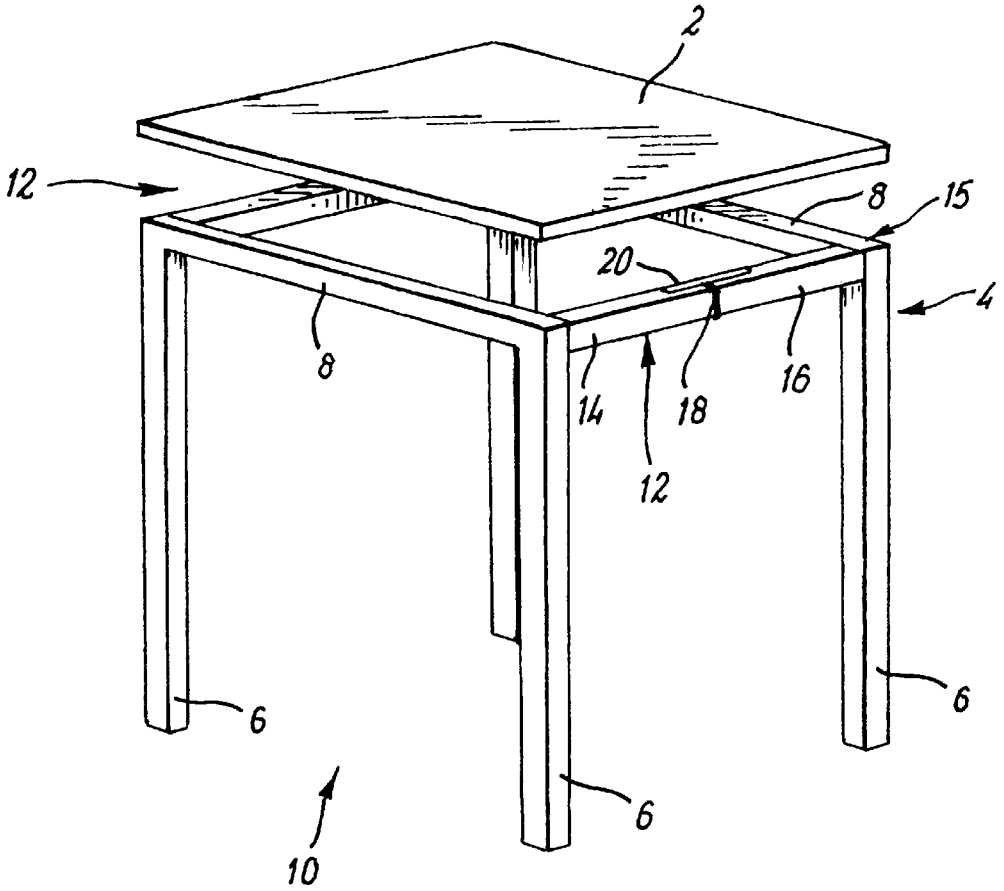
FIG. 1 is a perspective view of a table system of the invention.

Referring to the drawings, a folding table system comprises a table top 2 and a collapsible structure 4. The collapsible structure 4 comprises four legs 6. Two connecting members 8 connect one end of each of the two pairs of legs 6 to form two support frames 10. The support frames 10 are connected by two folding frame structures 12 each of which comprises a first member 14 connected by hinge means 15 to one support frame 10 and a second frame member 16 connected by a hinge means 15 to the other support frame 10, the first and second frame members 14, 16 being connected together by hinge 18.

Figure 3:
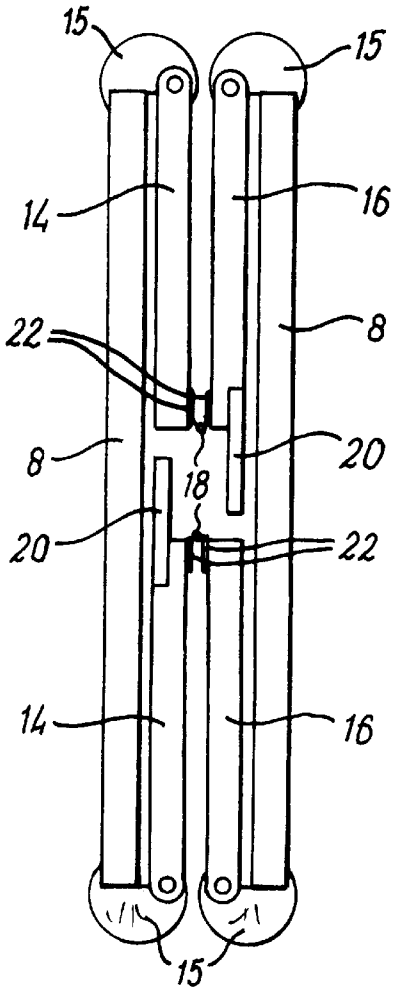
FIG. 3 is a plan view of the colapsible structure as shown in FIG. 2 in the fully collapsed position.
Figure 2:
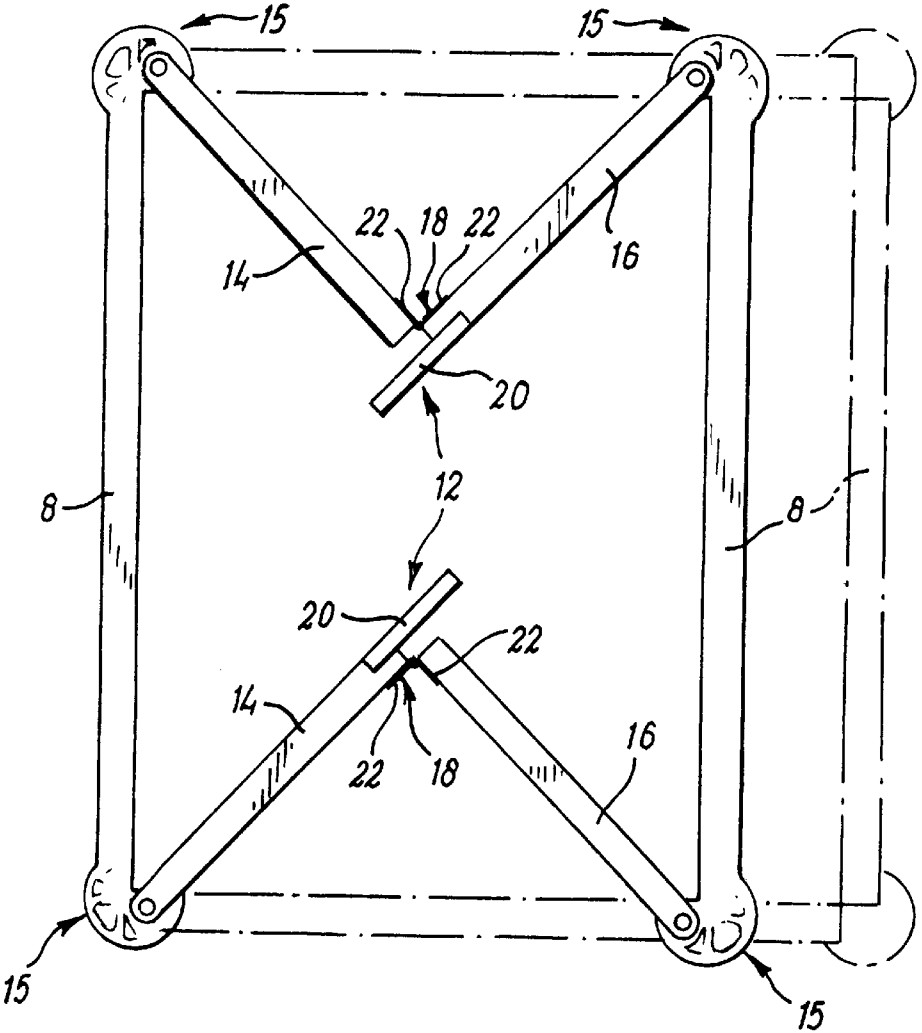
FIG. 2 is a plan view of the collapsible structure of FIG. 1 in the semi-collapsed position and with alternative corner joints.
Figure 5:
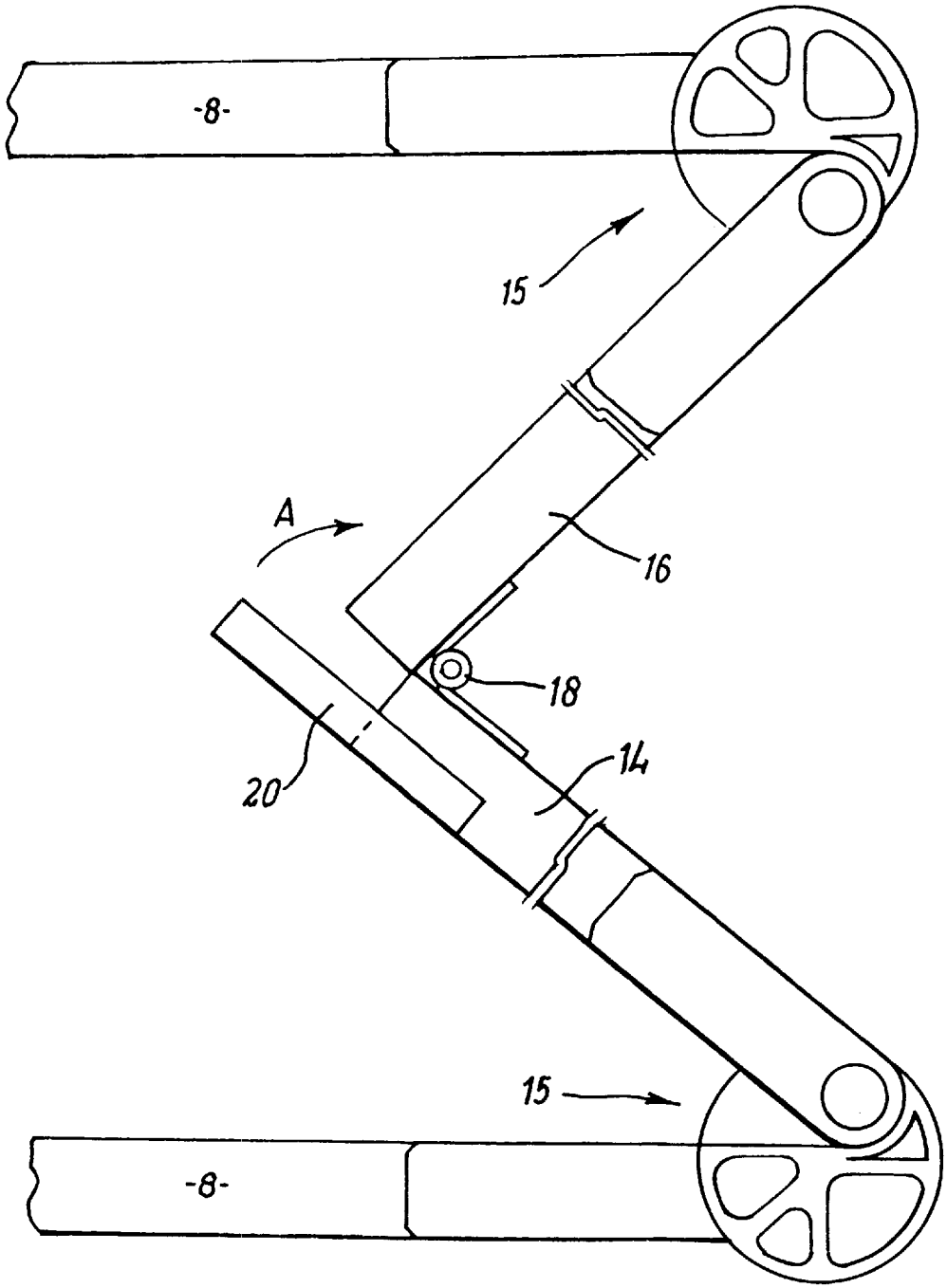
FIG. 5 is an enlarged plan view of one side of the collapsible structure of FIG. 2.

In use, the table is erected by separating the members 8 so that the hinges 18 are fully opened and the members 14 and 16 align to span the width of the table. The table top is then placed on the opened structure 4. To collapse the table, the table top 2 is removed and the members 8 brought together so that the members 14 and 16 pivot with respect to each other and with respect to the members 8 as shown in FIG. 2. In the fully collapsed position the members 14 and 16 lie substantially parallel to the members 8 as shown in FIG. 3.

Figure 4:
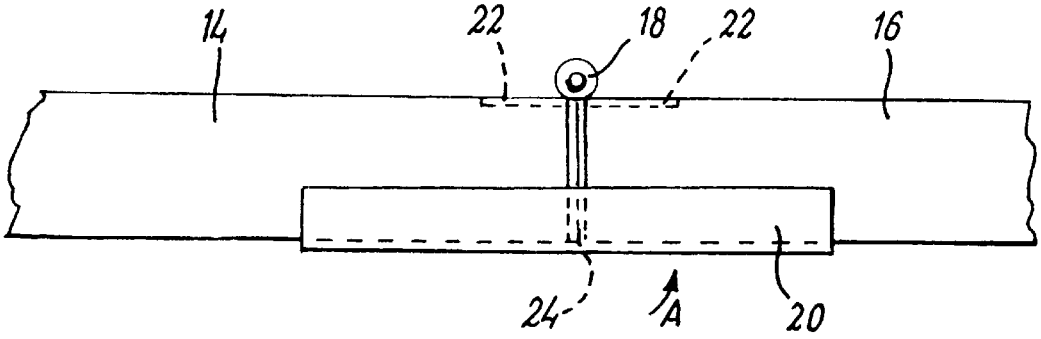
FIG. 4 is an enlarged plan view of the central hinge region of the collapsible structure of FIG. 1.

Referring in particular to FIG. 4 a cover member 20 may be provided on the frame structure 12 so that it can be swung over the hinged joint at 18 when the structure is erected to provide extra strength and to conceal the hinged joint formed between the members 14 and 16. Thus the cover member 20 acts as a reinforcement to the central joint. Pressure applied to the joint will be taken up by the cover member 20 so that undue pressure cannot be applied to the hinge 18 itself.

Use of a reinforcing cover member 20 at the central hinge location thus obviates the need for elaborate frame members in the folding frame structures 12 so that simple single element frame members 14 and 16 are sufficient. The cover member 20 carries the weight of the table top 2 or similar surface, and any weight applied thereto, at the central hinge location 18. Typically the cover member 20 comprises a channel section member slidably or otherwise located in the direction of arrow A over one end of one of the frame members 14, 16 as the structure is opened. The other end of the cover member 20 may be secured for example by bonding or welding to the adjacent end of the other frame member 16, 14.

Preferably the cover member 20 is arranged centrally around the central hinge joint 18 when in use, as shown in FIG. 4. When the structure is in the closed position as shown in FIG. 3, the cover member 20 extends beyond the end of the frame member 14, 16 to which it is secured and between that end and the opposing end of the second frame member 14, 16. The cross-sectional shape of the cover member 20 generally corresponds to that of, and is a close fit on, the frame member to which it is secured. Preferably the cover member is also a close fit on the frame member over which it is slidably located.

As shown in FIGS. 2 and 3, the hinge plates 22 of the hinge 18 may be secured externally to the adjacent ends of the frame members 14 and 16. However, it is preferred that the hinge plates 22 of the hinge 18 be secured internally to the adjacent ends of the frame members 14 and 16 as shown in FIG. 4. In particular, the frame members 14, 16 may comprise hollow section members, the hinge plates 22 being secured, for example by welding, to the internal side walls of the members.

The cover member 20 effectively conceals the gap 24 formed between the adjacent ends of the frame members 14, 16 opposite hinge 18.

Figure 6:
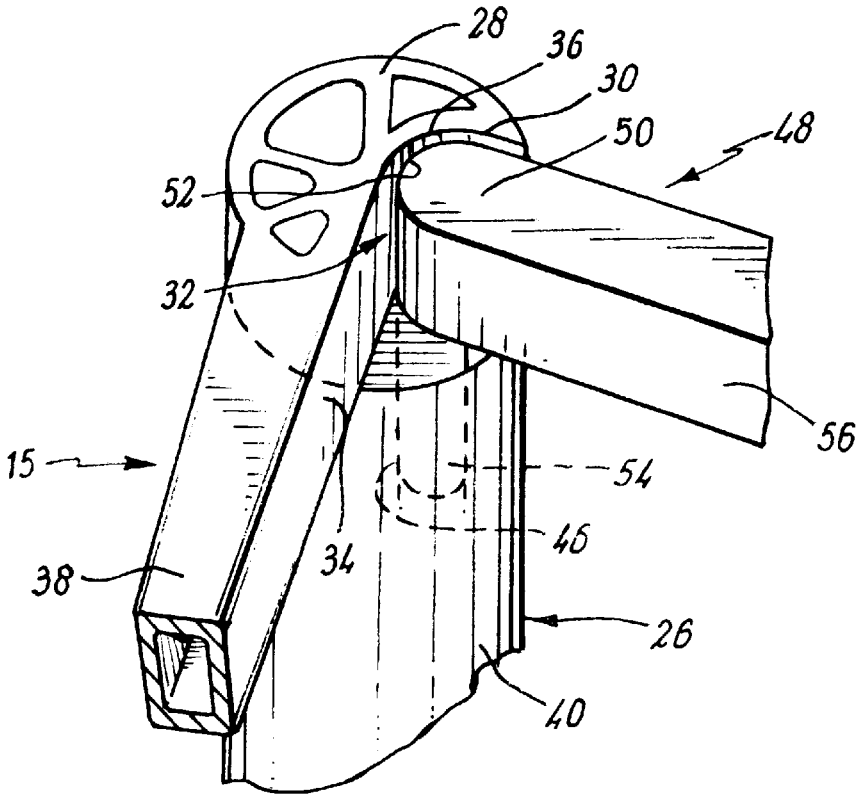
FIG. 6 is a perspective view of one form of corner joint of the structure with center portions of the legs shown broken away.
Figure 7:
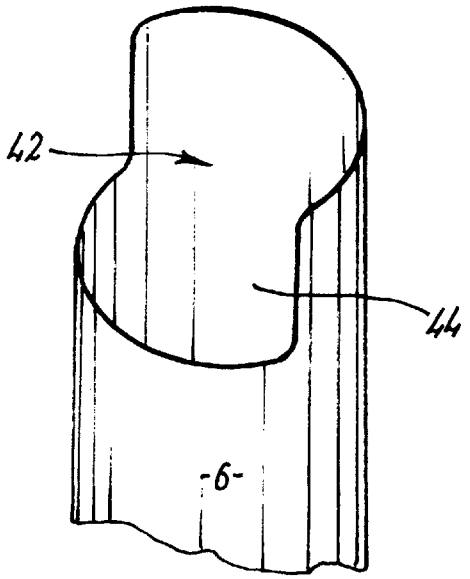
FIG. 7 is a perspective view of the upper leg region of the structure which accommodates the corner joint shown in FIG. 6.

Referring to FIG. 6, hinge means 15 comprises an elongate member 26 of generally circular cross-section. An upper region 28 of the member 26 has a recess 30 formed therein. The side wall 32 of the recess 30 has a straight portion 34 and an end curved portion 36. A horizontally projecting lug 38, typically of rectangular cross-section, extends from the upper region 28 generally in the direction of the straight portion 34 of the side wall 32. A lower region 40 of the elongate member 26 extends downwardly from the upper region 28 and is adapted to engage preferably, with a close fit or press fit in an aperture or recess 42, formed in the upper end of the leg 6 of the collapsible structure, as shown in FIG. 7. The aperture 42 may comprise a hollow end of the leg 6 which preferably has a cut-out region 44 so that the lower region 40 of the member 26 fits within an uncut portion of the hollow end below cutout region 44 and the upper region 28 of the member 26 fits within the cut-out region 44, the lug 38 extending from the cut-out region 44.

An aperture 46 which may be a through aperture, is formed in the lower region 40 and extends generally in the longitudinal direction of the elongate member 26. The aperture is open proximate of the recess 30 of upper region 28. A hinge member 48 comprises a base member 50 having a longitudinal dimension generally similar to the height of the side wall 32 and having a curved back wall portion 52 which corresponds to the end curved portion 36 of the recess 30 so that the base member 50 can pivot relative to the curved portion 36 about a pivot axis defined by the central axis of the aperture 46. A pivot pin 54 extends from the base member 50 and is adapted to engage in at least part of the aperture 46 to join the hinge member 48 to the elongate member 26 and to facilitate pivoting of the hinge member relative to the elongate member.

A horizontally projecting lug 56, typically of rectangular cross-section, extends from the base member 50 in a direction away from the curved back wall portion 52.

In use, the hinge means 15 is mounted on the support structure by connecting the elongate member and the hinge member as aforesaid, inserting for example as a press fit, the elongate member into the upper region of a leg 6 and connecting corresponding connecting members 8 and frame members 14, 16 to the lugs 38 and 56. Typically the ends at least of the connecting members and frame members will be hollow and shaped so that the lugs 38 or 56 may be pushed therein to form a close fit or press fit.

Figure 8:
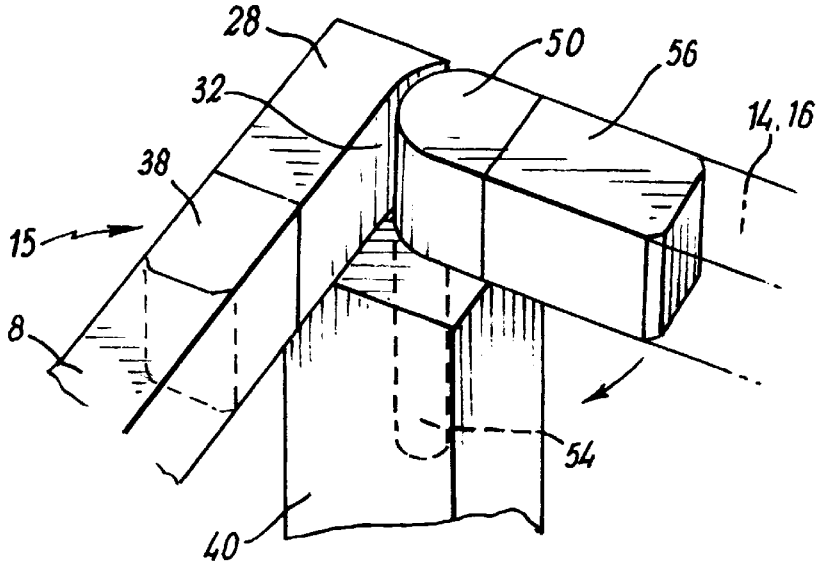
FIG. 8 is a perspective view of another form of corner joint of the structure.
Figure 9:
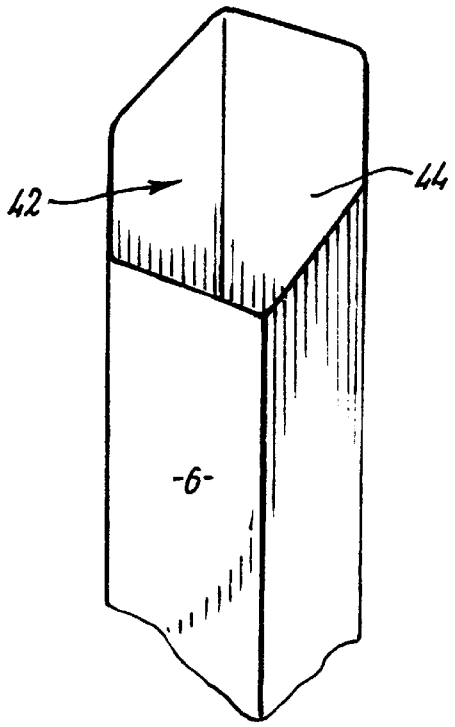
FIG. 9 is a perspective view of the upper leg of the structure which accommodates the corner joint shown in FIG. 8.

Referring to FIGS. 8 and 9, an alternative embodiment of hinge means 15 is generally similar to that described with reference to FIGS. 6 and 7. However, in this case the elongate member 26 and the leg 6 have a generally rectangular or square cross-section.

We claim:

1. A collapsible structure comprising a plurality of legs, connectors extending between the legs, and a plurality of hinges, each hinge associated with a respective leg each hinge comprising first and second members, each of said first and second members engaging one of said connectors said first and second members being pivotally engaged with each other to permit relative pivotal movement therebetween about a pivot axis, wherein the first member includes an aperture and the second member includes a pin adapted to be received in said aperture, the relative pivotal movement being achieved by the rotation of the pin within said aperture, each of said plurality of legs having a top formed to receive the first member with the pivot axis parallel to the leg, thereby permitting said relative pivotal movement between said first and second members.

2. The collapsible structure of claim 1, wherein said first member includes at least two support means for supporting said first member between one of said connectors and one leg respectively.

3. The collapsible structure of claim 2, wherein said support means comprise outwardly extending projections which are adapted to be fit within a part of each of the connecting member and the leg.

4. The collapsible structure of claim 3, wherein said outwardly extending projections extend orthogonally outward from a body of said first member.

5. The collapsible structure of claim 1, wherein said second member includes means for engaging said second member with a connecting member, said means comprising an outwardly extending projection adapted to be fit within part of said connecting member.

6. The collapsible structure of claim 1, wherein said first member comprises a body having a recess formed therein, the recess having a concave surface and wherein said second member comprises a body including a convex side wall so that in use, the second member is located within the recess of the first member so that the concave surface lies adjacent the convex side wall.

7. The collapsible structure of claim 1, in which some of the connectors are folding members for allowing the structure to be transformed between erected and collapsed configurations such that the largest external horizontal dimension of the structure in the collapsed configuration does not exceed the largest external horizontal dimension of the structure in the erected configuration, each folding member having two frame parts pivotally joined at a central region thereof and each end of each folding member being mounted to a respective second member adjacent a corresponding leg of the structure.

8. The collapsible structure of claim 7, wherein one frame part is provided with a cover member adapted to cover the central region when the structure is in the erected configuration.

9. The collapsible structure of claim 8, wherein part of the cover member is secured to one of the frame parts at one side of the central region.

10. The collapsible structure of claim 9, wherein the cover member comprises an elongate channel-section member.

11. The collapsible structure of claim 8, wherein the cover member comprises an elongate channel.

12. The collapsible structure of claim 8, wherein the cover member is a sliding cover adapted to slide over at least part of the folding members when the structure is in said erected configuration.

13. The collapsible structure of claim 12, wherein part of the cover member is secured to the folding member at one side of the central region.

14. The collapsible structure of claim 12, wherein the cover member is a perspective view of a table system of the invention: comprises an elongate channel.

15. A table comprising a table-top supported by a collapsible structure comprising a plurality of legs, connectors extending between the legs, and a plurality of hinges, each hinge associated with a respective leg, each hinge comprising first and second members, each member adapted to engage one of said connectors, the first and second members being pivotally engaged to permit relative pivotal movement therebetween about a pivot axis wherein the first member includes an aperture and the second member includes a pin adapted to be received in said aperture, the relative pivotal movement being achieved by the rotation of the pin within said aperture, each leg having a top formed to receive the first member, said pivotal axis being parallel to the leg, thereby permitting said relative pivotal movement between the first and second members.

* * * * *